US005090314A

United States Patent [19]

Miescher et al.

[11] Patent Number: 5,090,314

[45] Date of Patent: Feb. 25, 1992

[54] INKING AND DAMPENING MECHANISM FOR A REVERSIBLE PRINTING UNIT OF A ROTARY OFFSET PRINTING PRESS

[75] Inventors: Andreas Miescher, Ittigen; Peter Gertsch, Niederscherli; Robert Imhof, Bern, all of Switzerland

[73] Assignee: Maschinenfabrik Wifag, Bern, Switzerland

[21] Appl. No.: 686,416

[22] Filed: Apr. 16, 1991

[30] Foreign Application Priority Data

Apr. 17, 1990 [DE] Fed. Rep. of Germany ..... 4012283

[51] Int. Cl.[5] ..... B41F 7/26; B41F 7/36; B41F 7/40

[52] U.S. Cl. ..... 101/148; 101/350

[58] Field of Search ..... 101/148, 147, 350, 349, 101/363, 351, 352, 364, 207, 208-210

[56] References Cited

U.S. PATENT DOCUMENTS 3,805,700 4/1974 Chambon ..... 101/148

4,690,055 9/1987 Fadner ..... 101/350 X

*Primary Examiner*—J. Reed Fisher

*Attorney, Agent, or Firm*—McGlew & Tuttle

[57] ABSTRACT

A reversible printing unit is equipped with a central distributing roller (9), with which a first transfer cylinder (8) and a second transfer cylinder (12) can be engaged or disengaged independently from one another. A respective dampening mechanism (10) and (24) is associated with each of the transfer cylinders (8) and (12). Depending on the direction of rotation or the mode of operation of the printing unit, the transfer cylinders (8) or (12) and the rollers following them act as dampening rollers or inking rollers. Modes of operation with indirect dampening, pre-inking of the inking mechanism with feed of dampening agent, and rapid and thorough washing of the rollers of the inking and dampening mechanism are also possible due to the independent adjustment of the respective transfer cylinders (8) and (12).

7 Claims, 5 Drawing Sheets

INKING AND DAMPENING MECHANISM FOR A REVERSIBLE PRINTING UNIT OF A ROTARY OFFSET PRINTING PRESS

FIELD OF THE INVENTION

The present invention pertains to an inking and dampening mechanism for a reversible printing unit of a rotary offset printing press including a central distributing roller and plural inking rollers which transfer ink from a ducter roller to the central distributer roller, and an arrangement including a first applicator roller and a second applicator roller which are engaged with a first distributing roller and a second distributing roller, respectively and a first and second transfer cylinder which are engaged with the first distributing roller and second distributing roller, respectively and at least one addition applicator roller which is arranged between the first and second applicator rollers and which is engaged with the central distributing roller, a plate cylinder being provided in contact with the applicator rollers and a blanket cylinder cooperating with a plate cylinder is also provided along with two dampening agent metering devices.

BACKGROUND OF THE INVENTION

Such a reversible printing unit has been known, e.g., from Swiss Patent Specification No. CH-PS 557,238. Two central distributing rollers, which can be connected via reversible transfer cylinders, are arranged in the inking mechanism of this printing unit. The first central distributing roller is inked via a number of inking rollers, which receive ink from a ductor roller. The second central distributing roller receives ink from a transfer cylinder, which comes into contact with both central distributing cylinders. The other transfer cylinder connects the second central distributing roller to another distributing roller, which transfers the ink to an applicator roller. A distributing roller, which in turn is in contact with another applicator roller, is arranged symmetrically to the second central distributing roller. The two transfer cylinders are mounted rotatable on angle levers pivoted around the second central distributing roller. The two transfer cylinders are continuously in contact with the second central distributing roller. In a first position, a transfer cylinder connects the first central distributing roller to the second central distributing roller, while the other transfer cylinder connects the second central distributing roller to another distributing roller. The symmetrical distributing roller and the corresponding applicator roller are excluded from the ink flow, and they assume the task of dampening, because one dampening mechanism is associated with each of the two symmetrical distributing rollers. When the transfer cylinders are pivoted together, the ink flows via the other distributing roller, while the first distributing roller assumes the dampening function.

The plate cylinder can always be pre-dampened with this device, i.e., the dampening agent is applied by the ink to the plate cylinder, even when the direction of rotation of the plate cylinder is reversed. This pre-dampening is desirable in some cases.

The configuration of the inking and dampening mechanism permits only this type of supply of the dampening agent for the plate cylinder, which is the so-called direct dampening.

Indirect dampening, i.e., application of the dampening agent to the plate cylinder and introduction of the dampening agent into the inking mechanism, is impossible with this arrangement.

When changing from one printing ink to another, the inking mechanism must be cleaned, which normally takes place automatically. The rollers of the dampening mechanism must be cleaned as well. To do so, a washing device must be brought into contact with e.g., one of the central distributing rollers. To permit cleaning of all rollers of the inking and dampening mechanism, cleaning have must be performed via the plate cylinder. However, this has the disadvantage that rapid and thorough cleaning of the rollers of the inking and dampening mechanism is not possible.

SUMMARY AND OBJECTS OF THE INVENTION

It is an object of the present invention to arrange the rollers of the inking and dampening mechanism of a reversible printing unit such that versatile and product-dependent possibilities of supplying dampening agent are guaranteed; that automatic washing of the rollers of the inking and dampening mechanism can be carried out rapidly and thoroughly; and that dampening of the inking mechanism is possible even in the case of pre-inking of the rollers of the inking mechanism.

According to the invention, a central distributing roller is provided and first and second transfer cylinders are provided which are engaged with a first distributing roller and a second distributing roller, respectively, and which can be engaged with and disengage from the central distributing roller. A first applicator roller and a second applicator roller are engaged with the first distributing roller and second distributing roller and an additional applicator roller is provided which is arranged between the first and second applicator rollers and is engaged with the central distributing roller. A plurality of inking rollers are provided which transfer ink from a ductor roller to the central distributing roller. The first transfer cylinder is mounted in an engaging and disengaging means for engaging and disengaging the first transfer cylinder form the central distributing roller. The second transfer cylinder is mounted in a second engaging and disengaging means for engaging and disengaging the second transfer cylinder from the central distributing roller. A first dampening mechanism is provided adjacent the first transfer cylinder providing a metered dampening agent to the first transfer cylinder. A second dampening mechanism is provided adjacent the second transfer cylinder for providing a metered dampening agent to the second transfer cylinder. The first engaging and disengaging means includes a first actuator and the second engaging and disengaging means includes a second actuator are provided such that the first and second actuators can be operated individually such that each transfer cylinder can be engaged with or disengaged from the central distributing roller individually. Each of the applicator rollers may be engaged and disengaged with a plate cylinder and a blanket cylinder is provided cooperating with the plate cylinder.

The two dampening mechanisms are preferably designed as contactless dampening mechanisms. Further, the arrangement is provided such that depending on the direction of rotation of the central distributing roller, the ink transfer cylinder can be engaged either with the central distributing roller or with an intermediate roller which is in turn in contact with the central distributing roller. A washing device may be provided consisting of a spray bar, a doctor blade and a collecting device which may be engaged with the central distributing roller.

By arranging the transfer cylinders on pivoted levers, which can be pivoted around the first distributing roller or the second distributing roller, and which can consequently be engaged with and disengaged from the central distributing roller, it becomes possible to guarantee the different variants of dampening of the printing unit and the inking mechanism.

However, it is also imaginable that the first and second transfer cylinders are mounted in two roller locks each, which are equipped with linear drives, with which the two transfer cylinders can be engaged with and disengaged from the central distributing roller. The linear drives may preferably be arranged in the tangential direction relative to the respective first and second distributing rollers. It is also advantageous to arrange one other linear drive in the radial direction relative to the respective first and second distributing rollers in each roller lock in order to adjust even the position of the corresponding transfer cylinder relative to the respective first and second distributing rollers.

Dampening of the inking mechanism during the pre-inking process with the applicator rollers disengaged from the plate cylinder is possible. As a result, an ink-water equilibrium, which will lead to less spoilage at the start of production, is already reached at the time of pre-inking of the inking mechanism.

So-called contactless dampening mechanisms are advantageously used as dampening mechanisms. These may be, e.g., contactless brush type dampening mechanisms or contactless spray type dampening mechanisms. These have the advantage of not having to be in direct contact with a roller, and consequently of being able to dampen a roller independently from the amount by which the roller in question is adjusted.

One embodiment of the present invention is shown in the drawing and will be described in greater detail below.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
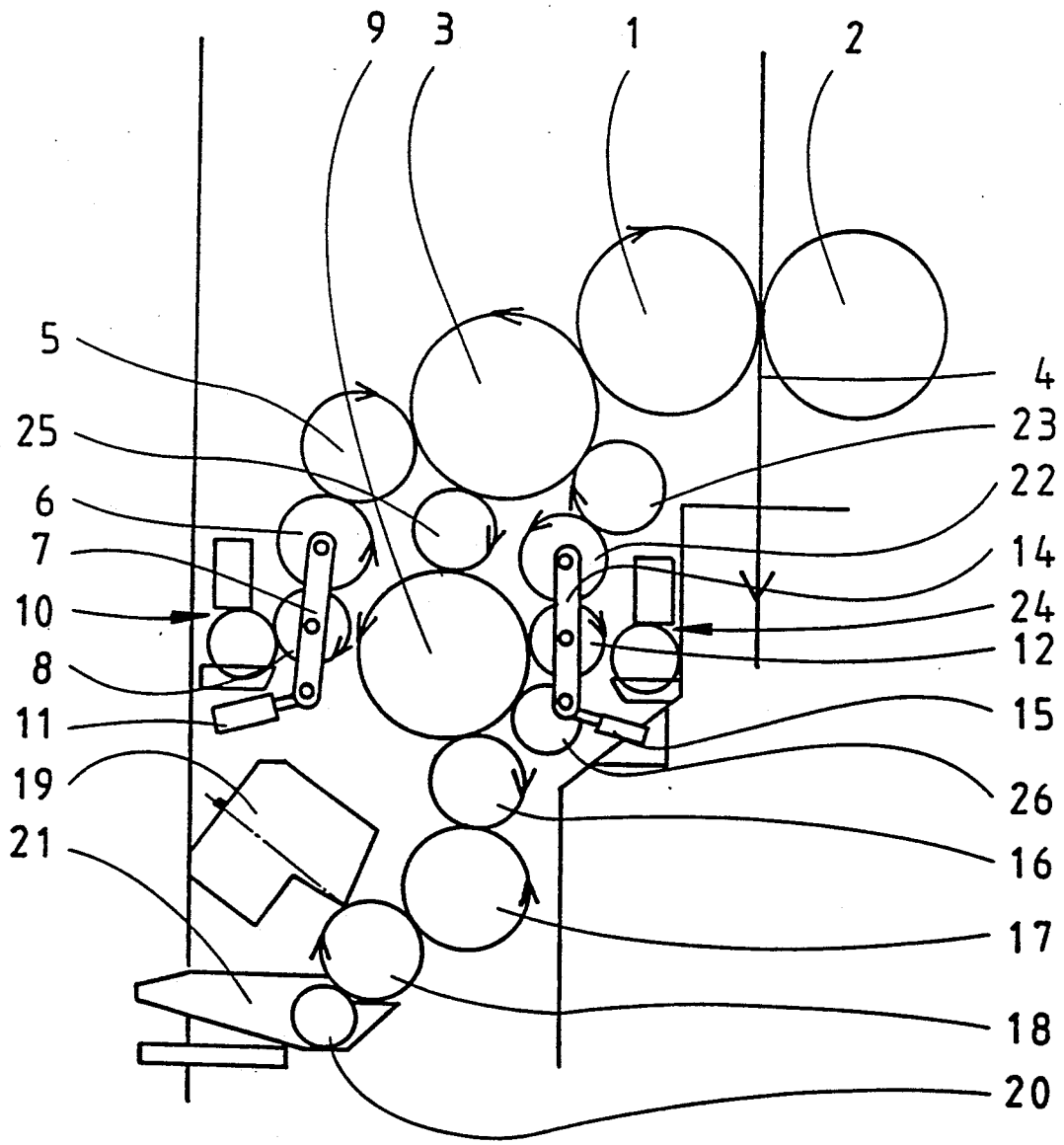
FIG. 1 is a schematic representation of a printing unit with a blanket cylinder rotating clockwise and with direct pre-dampening of the plate cylinder.

The printing unit shown in FIG. 1 consists of a blanket cylinder 1, which is provided with another cylinder 2, which is designed as a counterpressure cylinder or blanket cylinder of an adjacent printing unit, and a plate cylinder 3. The paper web 4, which passes through between the blanket cylinder 1 and the cylinder 2, moves from top to bottom in the case of the blanket cylinder 1, which rotates clockwise in this case.

A first applicator roller 5 is engaged with the plate cylinder 3. The first applicator roller 5 is in contact with a first distributing roller 6. One pivoted lever 7 each, on which the first transfer cylinder 8 is mounted freely rotatably, is pivotably mounted on the front side around the axis of rotation of the first distributing roller 6. The first transfer cylinder 8 is disengaged from the central distributing roller 9 by the actuator 11, and receives a spray of dampening agent via a contactless dampening mechanism 10. The first transfer cylinder 8, the first distributing roller 6, and the first applicator roller 5 transfer the dampening agent to the plate cylinder 3, and the desired pre-dampening is thus achieved.

The second transfer cylinder 12, which in turn is rotatably mounted in pivoted levers that are arranged pivotably around the second distributing roller 14, is engaged with the central distributing roller 9 by means of the actuator 15. The central distributing roller 9 is inked in the known manner via the reversible inking roller 16, the ink film roller 17, the ink ductor 18, onto which the ink is metered via doctor knives arranged in the doctor knife bars 19, and via the fountain roller 20, which dips into the ink in the ink fountain 21.

The second transfer cylinder 12 thus transfers the ink from the central distributing roller 9 to the second distributing roller 22, from which it is applied to the plate cylinder 3 via the second applicator roller 23. The dampening mechanism 24 is not in operation in this mode of operation of the printing unit.

An additional applicator roller 25, which is in contact with the central distributing roller 9 and thus also inks the plate cylinder 3, is arranged between the first applicator roller 5 and the second applicator roller 23. In this mode of operation, which is shown in FIG. 1, when the blanket cylinder 1 rotates clockwise, the rollers 8, 6, and 5 fully assume the function of the simple dampening mechanism rollers, while the rollers 12, 22, and 23 fully assume the function of simple inking mechanism rollers. Thus, optimal pre-dampening of the plate cylinder 3 is achieved for printing newspapers.

Figure 2:
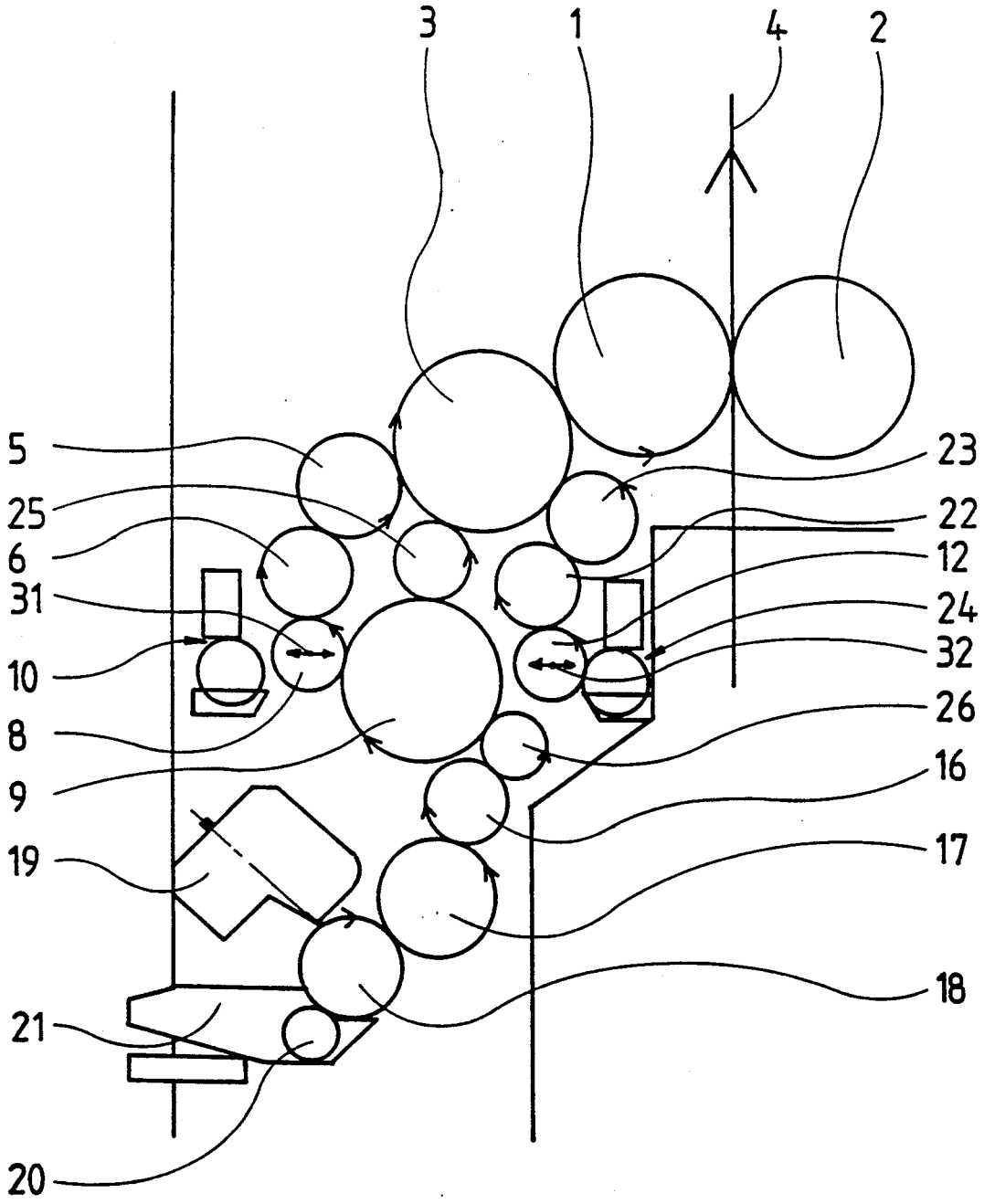
FIG. 2 is a schematic representation showing the same printing unit as shown in FIG. 1 with the blanket cylinder rotating counterclockwise and with direct pre-dampening of the plate cylinder.

FIG. 2 shows the same printing unit as FIG. 1, but for a blanket cylinder 1 rotating counterclockwise. To achieve optimal direct pre-dampening of the plate cylinder 3 in this mode of operation as well, the first transfer cylinder 8 is brought into contact with the central distributing roller 9.

Engagement and disengagement are performed here via a linear drive 31, which is arranged in the roller lock (not shown) and can be driven pneumatically or electrically.

In contrast, the second transfer cylinder 12 is disengaged from the central distributing roller 9. Engagement and disengagement are performed via a liner drive 32, which is arranged in the roller lock (not shown) and is driven electrically or pneumatically, in this case as well. The dampening mechanism 10 is put out of operation. Thus, the rollers 8, 6, and 5 fully assume the function of inking mechanism rollers, and the rollers 12, 22, and 23 are used as simple dampening mechanism rollers.

Especially, the two distributing rollers 6 and 22, which are provided with a hard or hard elastic surface, must assume the function of both a dampening roller and of an inking roller. Experiments have shown that this dual function is assumed very well with a copper surface. It would also be imaginable that the two distributing rollers 6 and 22 are made from a suitable plastic or a ceramic material.

Since the central distributing roller 9 also reverses its direction of rotation in the mode of operation according to FIG. 2 relative to the mode of operation according to FIG. 1, whereas the fountain roller 20, the ink ductor 18, the ink film roller 17, and the reversible inking roller 16 should always have the same direction of rotation, the reversible inking roller 16 can be disengaged from the central distributing roller 9 and be engaged with an inking roller 26, which is continuously in contact with the central distributing roller 9. The reversal of the movement can thus be compensated.

Figure 3:
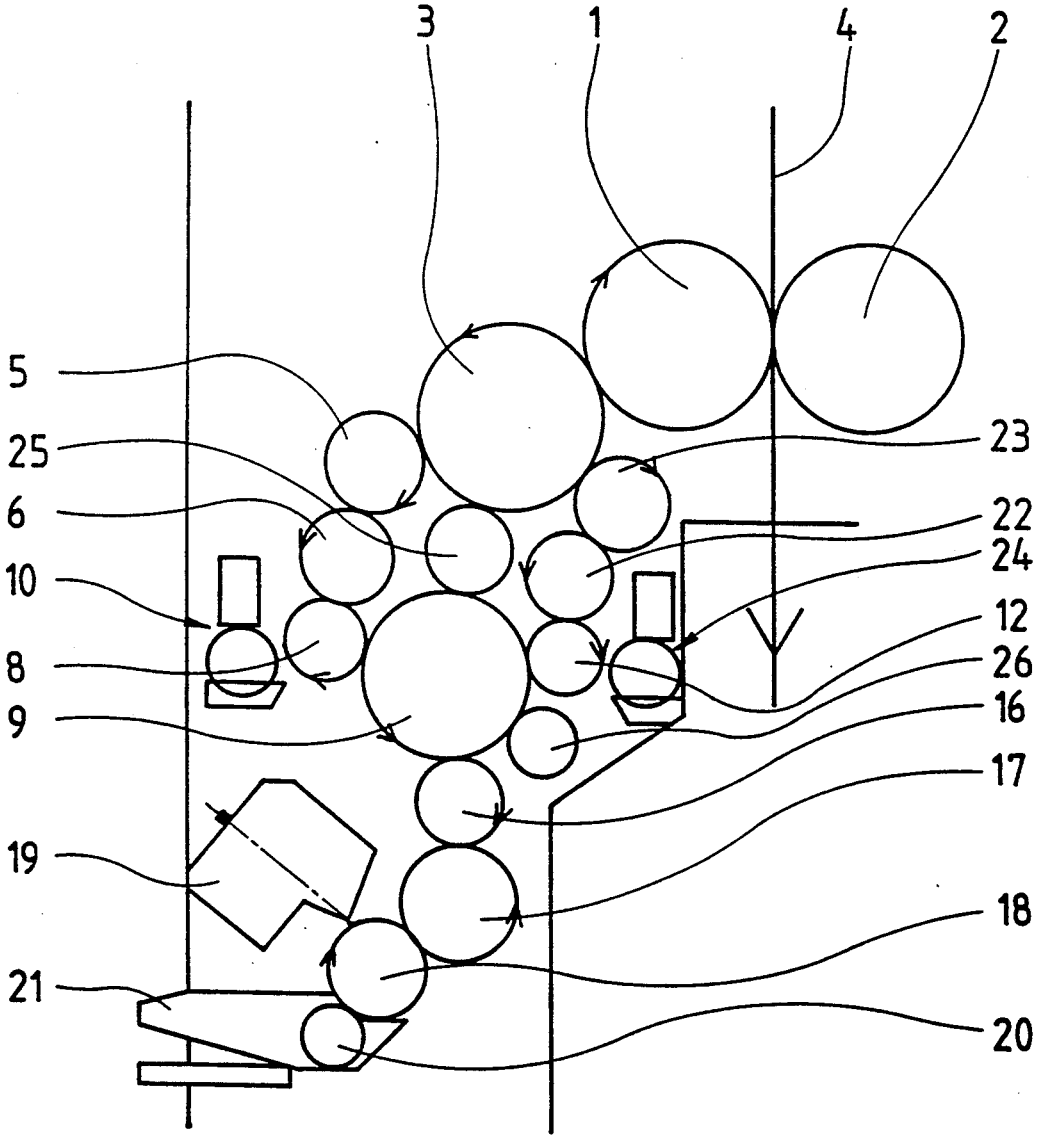
FIG. 3 is a schematic representation showing the same printing unit as shown in FIG. 1 with the blanket cylinder rotating clockwise and indirect dampening.

It is advantageous, especially for delicate print patterns, for the plate cylinder 3 to be able to be dampened indirectly. This mode of operation is shown in FIG. 3. The blanket cylinder 1 rotates clockwise. Both the first transfer cylinder 8 and the second transfer cylinder 12 are engaged with the central distributing roller, and consequently they act as inking rollers. The dampening mechanism !0 is in operation and dampens the first transfer cylinder. The dampening agent thus enters the inking mechanism proper, but it also reaches the plate cylinder 3 via the rollers 6 and 5.

Figure 4:
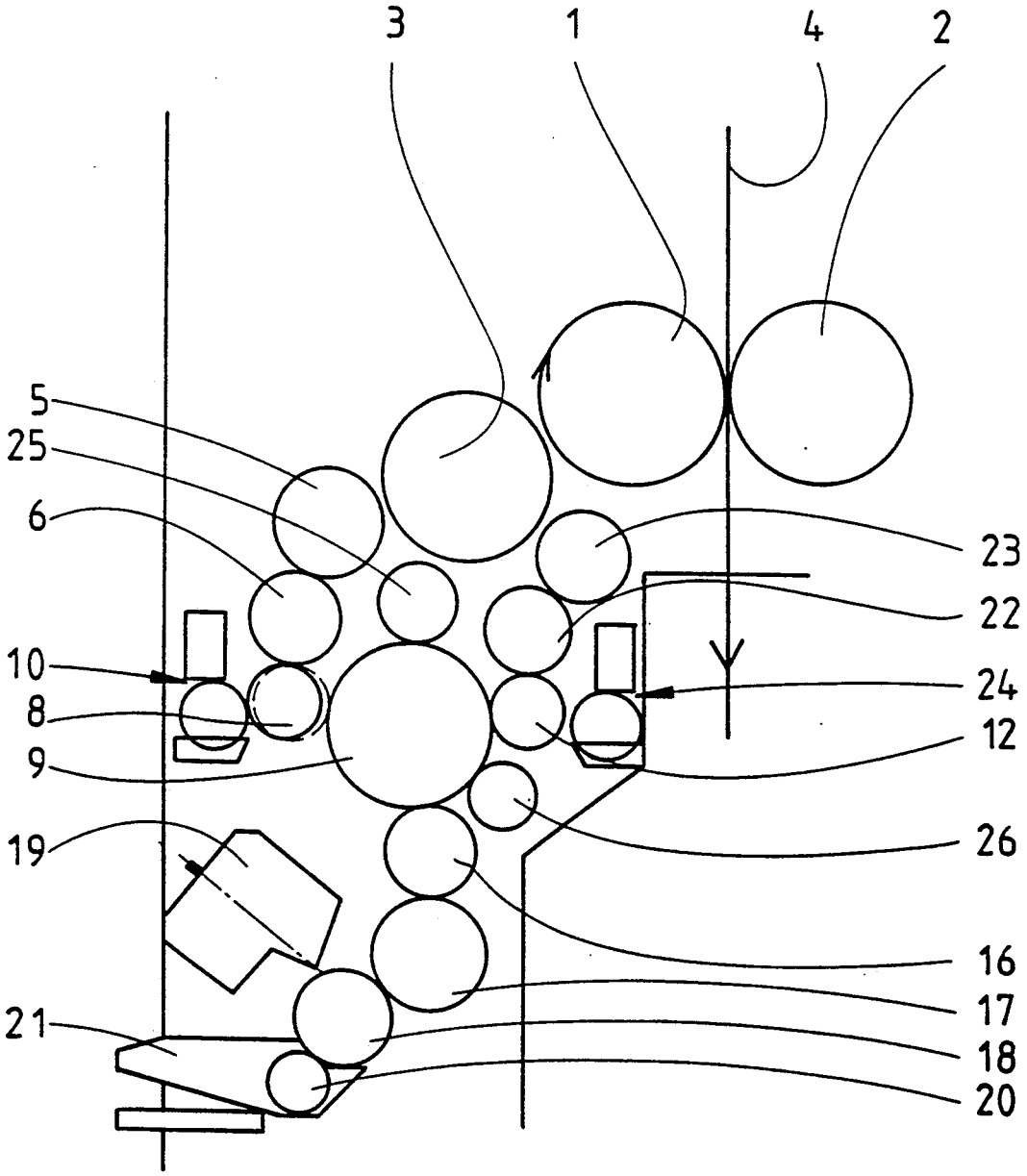
FIG. 4 is a schematic representation showing the same printing unit as shown in FIG. 1 with the blanket cylinder rotating clockwise during the pre-inking phase.

Before production is started with such a printing unit, the inking mechanism is pre-inked in order to reduce spoilage. As is shown in FIG. 4, the applicator rollers 5, 25, and 23 are again disengaged from the plate cylinder 3 for this purpose. The first transfer cylinder 8 is disengaged from the central distributing roller 9. The second transfer cylinder 12 is engaged with the central distributing roller 9. All inking mechanism rollers are now pre-inked by allowing the printing unit to rotate. To do so, the doctor knife screws in the doctor knife bar 19 which can be preset from the scanner corresponding to the pattern to be printed. However, it is also possible to adjust the ductor knife screws to an average. The purpose of pre-inking the dampening mechanism rollers is to reduce the spoilage at the beginning of printing. This spoilage can be further reduced by establishing an equilibrium between ink and dampening agent in the inking mechanism already during pre- inking. To do so, the transfer cylinder 8 is briefly engaged with the central distributing roller 9, the dampening mechanism 10 is put into operation, and the necessary amount of dampening agent is thus released into the inking mechanism.

At the beginning of printing, the applicator rollers 5, 25, and 23 are engaged with the plate cylinder. Since an equilibrium between ink and dampening agent has been established in the inking mechanism, satisfactory printed products will be obtained in a very short time.

It is clear that the modes of operation shown in FIGS. 3 and 4 for the blanket cylinder 1 rotating clockwise can also be used for a blanket cylinder 1 rotating counterclockwise by symmetrically transposing the roller positions.

Figure 5:
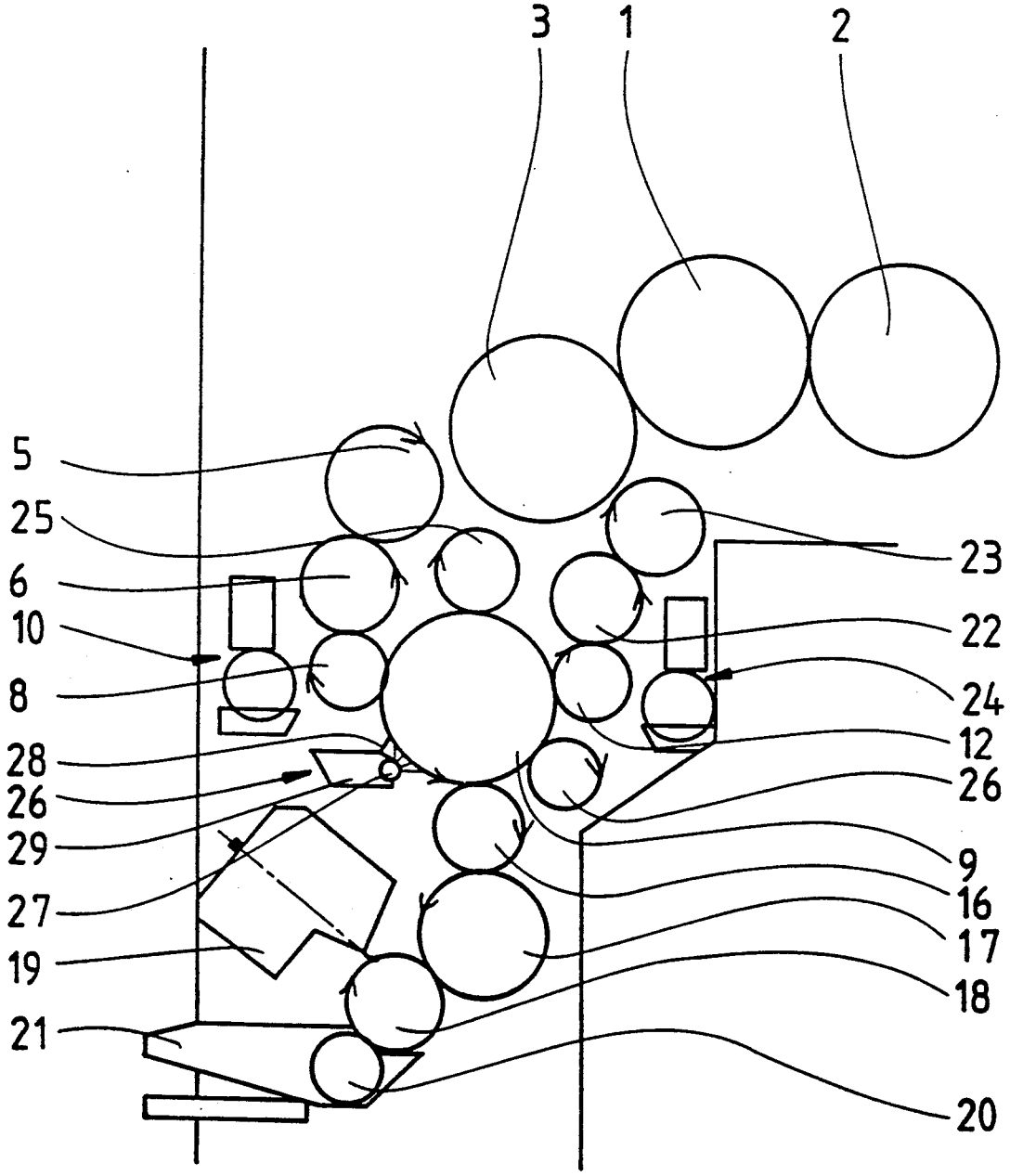
FIG. 5 is a schematic representation showing the same printing unit as shown in FIG. 1 with the blanket cylinder rotating clockwise with washing device.

At the end of printing, or when another ink is to be used for printing, the inking and dampening mechanism must be cleaned. This is performed automatically in this case with a washing device 26 that can be engaged and is shown in FIG. 5. For washing, the applicator rollers 5, 25, and 23 are disengaged from the plate cylinder 3. The washing device 26, which can be engaged in the known manner, consists of a spray bar 27, a doctor blade 28, and a collecting reservoir 29 to collect the cleaning fluid wiped off. The first transfer cylinder 8 and the second transfer cylinder 12 are both engaged with the central distributing roller 9. The cleaning fluid sprayed onto the central distributing roller 9 is rapidly distributed over all rollers of the inking and dampening mechanism. The cleaning fluid returning to the central distributing roller 9 is wiped off completely by the ductor blade 28, and fed into the collecting reservoir 29. Rapid and thorough washing of the inking mechanism and dampening mechanism together is possible with the rollers positioned in the manner described here.

It is also possible to wash first only the rollers of the inking mechanism, which is done by disengaging the rollers of the dampening mechanism by disengaging the corresponding transfer cylinder 8 or 12. When the rollers of the inking mechanism are clean, the dampening mechanism can again be engaged with the central distributing roller 9 by engaging the corresponding transfer cylinder 8 or 12. The dampening mechanism is also washed at the same time. A possible inking of the rollers of the dampening mechanism with residual ink from the rollers of the inking mechanism is prevented by this procedure.

Washing is always carried out with the rollers rotating in the direction shown in FIG. 5. The dampening mechanisms 10 and 24 are not, of course, in operation.

While a specific embodiment of the invention has been shown and described in detail to illustrate the application of the principles of the invention, it will be understood that the invention may be embodied otherwise without departing from such principles.

What is claimed is:

1. An inking and dampening mechanism for a reversible printing unit of a rotary offset printing device, comprising:

a central distributing roller;

an inking roller arrangement for transferring ink from a ductor roller to said central distributing roller;

a first transfer cylinder and a second transfer cylinder;

a first distributing roller and a second distributing roller, said first distributing roller being supported engaged with said first transfer cylinder and said second distributing roller being supported engaged with said second transfer cylinder;

a first applicator roller and a second applicator roller, said first applicator roller being engaged with said first distributing roller and said second applicator roller being engaged with said second distributing roller;

at least one additional applicator roller, arranged between said first and second applicator rollers, said at least one additional applicator roller being engaged with said central distributing roller;

a plate cylinder positioned for engaging and disengaging each of said first nd second applicator roller and said at least one additional applicator roller;

a blanket cylinder positioned for cooperation with said plate cylinder;

a first dampening agent metering means positioned adjacent said first transfer cylinder for providing a dampening agent to said first transfer cylinder;

a second dampening agent metering means, positioned adjacent said second transfer cylinder, for providing a dampening agent to said second transfer cylinder;

first transfer cylinder engaging and disengaging means including a first actuator, for individually engaging or disengaging said first transfer cylinder from said central distributing roller; and second transfer cylinder engaging and disengaging means, including a second actuator, for individually engaging and disengaging said second transfer cylinder from said central distributing roller.

2. An inking and dampening mechanism in accordance with claim 1, wherein each of said first and second engaging and disengaging means, rotatably supports an associated transfer cylinder and includes a pivoted lever mounted for pivoting around an axis of a corresponding distributing roller.

3. An inking and dampening mechanism in accordance with claim 1, wherein each actuator of said first and second engaging and disengaging means includes a linear drive.

4. An inking and dampening mechanism in accordance with claim 1, wherein said first distributing roller and said second distributing roller each have surfaces which can be used both to carry ink and to carry a dampening agent.

5. An inking and dampening mechanism in accordance with claim 1, wherein depending on the direction of rotation of said central distributing roller, said ink transfer arrangement can be engaged either with said central distributing roller or with an intermediate roller that is in contact with said central distributing roller.

6. An inking and dampening mechanism in accordance with claim 1, wherein each of said first and second dampening agent metering means include contactless dampening mechanisms.

7. An inking and dampening mechanism in accordance with claim 1, further comprising a washing device including a spray bar, a doctor blade, and a collecting device mounted for engagement with said central distributing roller.

* * * * *